US006857936B2

(12) United States Patent
Jones et al.

(10) Patent No.: US 6,857,936 B2
(45) Date of Patent: Feb. 22, 2005

(54) BREAST SUPPORT GARMENT SYSTEM AND METHOD THEREFOR

(76) Inventors: Wendy Jones, 7952 Eagle Ranch Rd., Fort Collins, CO (US) 80528; Jennifer Weir, 1131 McHugh St., Fort Collins, CO (US) 80524

( * ) Notice: Subject to any disclaimer, the term of this patent is extended or adjusted under 35 U.S.C. 154(b) by 0 days.

(21) Appl. No.: 10/144,889

(22) Filed: May 13, 2002

(65) Prior Publication Data

US 2003/0003844 A1 Jan. 2, 2003

Related U.S. Application Data

(60) Provisional application No. 60/291,378, filed on May 16, 2001.

(51) Int. Cl.[7] ..... A41C 3/00
(52) U.S. Cl. ..... 450/86; 450/88
(58) Field of Search ..... 450/186, 88, 81, 450/62–64, 11, 12, 30, 31, 32, 55; 2/103, 208, 67, 105, 106, 69, 113, 114, 115, 73, 102, 78.1–78.3; D2/700–709, 712–715, 728–737, 756–762, 767, 796, 793, 846–847, 853, 854, 500–508

(56) References Cited

U.S. PATENT DOCUMENTS 2,389,450 A * 11/1945 Moy ..... 450/6
2,468,841 A * 5/1949 Siegal ..... 450/1
3,311,112 A * 3/1967 Murray ..... 450/86
3,489,153 A * 1/1970 Gaisser ..... 450/86
4,411,269 A * 10/1983 Weintraub ..... 450/86
6,009,556 A * 1/2000 Nenninger ..... 2/67
6,086,451 A * 7/2000 Fernandes ..... 450/86
6,186,863 B1 * 2/2001 Kim ..... 450/86
6,547,636 B1 * 4/2003 Cato

OTHER PUBLICATIONS

"Victoria's Secret Swim 2002 Catalog", vol. 2, No. 1, Provided by Victoria's Secret P.O. Box 16589, Columbus, Ohio 43216–6589, USA.

"Brazabra Website Materials" obtained from www.brazabra-.com Provided by Brazabra Corporation, Windstock Industrial Park, 8 Runway, Lee, Massachussets, 01238, USA.

* cited by examiner

*Primary Examiner*—Gloria M. Hale
(74) *Attorney, Agent, or Firm*—Timothy J. Martin; Michael R. Henson; Rebecca A. Gegick

(57) ABSTRACT

A garment structure in the form of a brassiere, halter-top, or bathing suit for supporting an individual's breasts, and methodology for wearing the same that has a flexible breast support piece, a left and a right bottom connector and a left and right side connector. The garment structure may also include an additional left and right bottom connector and an additional left and right side connector. The connectors may be in a variety of forms such as hooks, eyes, buttons, openings, snaps, and rings, and are adapted to receive a variety of support components that may be in the form of straps, beads, or a scarf. The appearance of the garment structure may altered by changing the configuration of the support components.

35 Claims, 6 Drawing Sheets

BREAST SUPPORT GARMENT SYSTEM AND METHOD THEREFOR

CROSS-REFERENCE TO RELATED APPLICATIONS

The present application claims the benefit of U.S. Provisional Application Ser. No. 60/291,378, filed on May 16, 2001, entitled "Backless and Strapless Brassiere".

FIELD OF THE INVENTION

The present invention generally relates to a garment adapted to support the breasts of an individual while wearing the garment. More particularly, the present invention is directed to a brassiere capable of being secured to an individual by a variety of straps formed in multiple configurations. The present invention is also directed to a method of securing the garment to the individual such that the garment may be worn in a supporting relationship with respect to the individual's breasts.

THE BACKGROUND OF THE INVENTION

Brassieres, or bras as they are commonly referred to today, have evolved over the years along with styles of clothing and the perception of female attractiveness with respect to certain cultures. For example during the Renaissance Period, it was fashionable in the European culture to have a very exposed bustline. Thus, in response to this trend, dresses were made to expose a woman's bustline that was further accentuated by undergarments such as corsets that pushed the breasts up and together and pulled in the waistline. Some time after the Renaissance Period, small breasts were in style making the corset the fashionable item to wear. By contrast, in America during the early 1900s, the perception of female attractiveness was one that favored smaller, unexposed breasts, prompting the development and manufacture of corsets designed to flatten the breasts rather than enhance them.

Since the early 1900s, the perception of female attractiveness has essentially reversed itself in many cultures. In America, for example, many view large breasts and clothing that exposes the female bustline to be fashionable and equate this type of appearance with sexual attractiveness. Accordingly, the fashion industry has developed bras that enhance the female breasts and clothing to expose the bustline.

Also, since the early 1900s, the fashion industry has also designed clothing that reveals more of the female body. One trendy or fashionable design that has been and remains popular among many women are articles of clothing that reveal the their backs, such as low-cut or backless clothing. For example, evening gowns, prom dresses, cocktail dresses, and the like that are low-cut in the back or backless are considered to be elegant by many men and women. The low-cut and backless look is also permeating into other types of clothing such as the backless halter-top which is considered among some of the trendy fashion items for the upcoming 2002 summer season.

The traditional or basic bra typically has two cups, a left cup for the left breast, and a right cup for the right breast, and four straps—two back straps and two shoulder straps. The two back straps are typically affixed to the bra cups to extend around the individual's torso with free ends that fasten at the back. The two shoulder straps are also usually affixed to the bra cups and extend over each shoulder and are affixed to a respective back strap. When worn with low-cut or backless articles of clothing, these four straps are usually exposed, which oftentimes detracts from the article of clothing. Accordingly, given the desire of many women to wear low-cut or backless articles of clothing, this basic bra design has had to evolve.

One way in which the basic bra design has evolved is to eliminate the need for shoulder straps. Thus, the entire support for the female's breasts must be achieved through both the cup design and the back straps. This type of bra is commonly referred to as the strapless bra, which can be worn with clothing that exposes the female's shoulders. However, the back straps of the strapless bra are still exposed if worn with low-cut or backless clothing.

Various efforts to design a bra that is both backless and strapless have been made. For example, Brazabar Corporation sells a bra having two disconnected breast cups without shoulder straps or back straps. The interior of each breast cup has an adhesive liner that allows the breast cups to be adhered to the breasts. Brazabar Corporation also makes a somewhat different backless, strapless bra in the form of two separate pieces of a tape-like adhesive material that sticks to the breasts. Unlike the first design described above, this second design lacks a structural breast cup framework, and is adapted to mold to the shape of the user. The wearer simply places the adhesive tape over the breasts to create a supported look. Finally, Brazabra Corporation also makes strap attachment accessories with hook and eye fasteners. These strap attachment accessories are designed to lengthen and pull down the back straps of the basic bra so as to conceal them from view.

The strapless and backless bras described above have several drawbacks. First, the two types of adhesive cups do not offer the same amount of support that the traditional bra offers which places larger breasted women at somewhat of a disadvantage. Secondly, with respect to the back strap accessories item described, the straps do not always eliminate the appearance of the bra's back strap. Accordingly, there is a long felt need for a brassiere that is able to be worn with low-cut or backless articles of clothing that provides support for the individual's breasts in the same or similar way as a traditional or basic bra. The present invention is directed to meeting those needs.

SUMMARY OF THE INVENTION

It is an object of the present invention to provide a new and useful garment that supports an individual's breasts when worn.

It is another object of the present invention to provide a fashionable, versatile garment to support the wearer's breasts and that may be worn alone or as an accessory to a backless article of clothing.

It is yet another object of the present invention to provide a garment to support an individual's breasts with adjustable components so that it may be either tightened or loosened as desired for its comfort or appearance.

A still further object of the present invention is to provide a comfortable brassiere with releasable shoulder straps and back straps.

Another object of the present invention is to provide a support for an individual's breasts that permits the individual to secure the support on her body by means of any desired configuration of straps, cords, strands of beads, scarves or the like.

Yet another object of the present invention is to prove a support for an individual's breasts that is attractive and that accessorizes her outfit.

According to the present invention, then, a garment is provided that is adapted to support an individual's breasts when worn. The garment may be in the form of a brassiere, a halter-top, a bathing suit, or the like. Broadly, the garment comprises a garment structure adapted to be placed in a supporting relationship with respect to the individual's breasts, and a garment support component with means for engaging the breast support piece so that it may be secured into a supporting relationship on the individual. To accomplish these means, the garment of the present invention broadly provides a garment structure in the form of a breast support piece that includes connectors, and a garment support component adapted to engage these connectors. The present invention contemplates a wide variety of designs for the breast support piece, connectors, and the garment support component, as well as a variety of ways in which they interact to create a new and useful garment as versatile as that which is the subject of this application.

The breast support piece generally includes a left section that is adapted to support the left breast and a right section adapted to support the right breast. When the breast support piece is placed in a supporting relationship to the individual's breasts, a left side edge extends laterally of the left breast, a right side edge extends laterally of the right breast, and a bottom edge extends below both breasts between the left and right side edges. In some embodiments, the breast support piece may also include a top edge that is spaced upwardly of the bottom edge and between the left and right side edges.

The breast support piece may be formed as an integral one-piece construction of fabric. Alternatively, the breast support piece may be in the form of breast cups having a respective interior concavity for receiving a respective breast and may optionally include an underwire structure. The breast support pieces may also be in the form of a framework that partially encircles the breasts and allows them to be exposed.

The connectors that are engaged by the garment support component are disposed on the breast support piece. The breast support piece may simply include a set of first connectors chosen from a group consisting of hooks, eyes, buttons, openings, snaps, and rings. Members of this first set of connectors may each be of a different type of connector or, in the alternative, each member may be of the same type connector. In addition to the first connectors, the breast support piece may also include a set of second connectors. The members of the second set of connectors may be hooks, eyes, buttons, openings, snaps, and rings. Here again, the members of this second set of connectors are not confined to be just one type of connector, but they can each be a different type of connector. Further, the members of the first connectors and the members of the second connectors can either be the same type of connector or be a different type.

The first connectors and, if included, the second connectors, are spaced apart from one another on the breast support piece and are generally disposed proximately to the edges of the breast support piece. Thus, for example, on the left section of the breast support piece there may be a first connector disposed proximately to the bottom edge and a first connector located upwardly thereof that is disposed proximately to either the top or side edge of the left section. Likewise, with respect to the right section of the breast support piece, a first connector may be disposed on the bottom edge with another connector located upwardly thereof that is disposed proximately to either the top or side edge. The second connectors, if included, could be similarly situated on the breast support piece and located proximately to a respective member of the first connectors.

The garment support component includes a means for engaging at least one connector and may be in the form of a strap, a strand of beads, and a scarf. The breast support piece may either be worn by one garment support component, or by a plurality of garment support components. The garment support component may also include a fastening element thereon to cooperate either with another garment support component or to enable it to fasten to itself to keep the breast piece in a supporting relationship on the individual. Further, the garment support component may also include a means by which its length may be adjusted.

The present invention contemplates that a wide variety of configurations may be formed by the garment support components that may be arranged in numerous ways to form shoulder straps and back straps. In some configurations, each garment support component may be entirely releasable from the breast support piece. Alternatively, one end of the garment support component may be affixed to the breast support piece while the other end remains free.

The present invention further contemplates a garment system adapted to support an individual's breasts when worn. The garment system is comprised of a backless article of clothing that includes two lateral side edges and a front panel extending therebetween. Each lateral side edge has an opening disposed in a margin proximate to each respective lateral side edge. The garment system also includes a breast support piece with connectors disposed thereon and at least one garment support component. The garment support component of this garment system is adapted to engage at least one of the breast support piece connectors and further adapted to extend through the openings of the article of clothing to secure both it and the breast support piece onto the individual. In one form, the backless article of clothing can be a dickey.

Finally, the present invention also includes a method for securing a garment to an individual's body that is adapted to support the breasts of the individual when worn. The steps include placing a breast support piece with connectors disposed thereon over the breasts, and using at least one garment support component to secure the breast support piece in a supporting relationship with respect to the individual's breasts. The method further includes the step of using a plurality of garment support members to engage to secure the breast support piece by forming multiple configurations of the garment support components.

These and other objects of the present invention will become more readily appreciated and understood from the consideration of the following detailed description of exemplary embodiments when taken together with the accompany drawings, in which:

BRIEF DESCRIPTION OF THE DRAWINGS

FIG. 12(*b*) is a rear view of a woman wearing the garment shown in FIG. 12(*a*);

FIGS. 12(*c*)–12(*f*) are rear views in elevation showing various strap ensembles that may be formed using either a single or a plurality of cords to secure the breast support piece;

FIG. 19(*b*) is a rear view in elevation of a woman wearing a garment contemplated by the present invention having a strap ensemble that may be configured using the two scarves as shown in FIG. 19(*a*);

DETAILED DESCRIPTION OF THE EXEMPLARY EMBODIMENTS

The present invention is directed to a garment that is adapted to support an individual's breasts when worn. The garment of the present invention may take the form of a brassiere (also referred to as a bra) or other type of undergarment, but it is not limited to the form of undergarment. Rather, the garment of the present invention may also be worn as outer clothing in the form of a halter-top, a bathing suit, etc. In addition, the garment may even be used as an accessory to a low-cut or backless article of clothing such as a dickey, a formal gown, etc. Another purpose of the present invention is to provide a garment that not only comfortably supports a woman's breasts, but that also has structural features that cater to the individual needs or desires of the wearer and allows her express her creativity and imagination.

Figure 1:
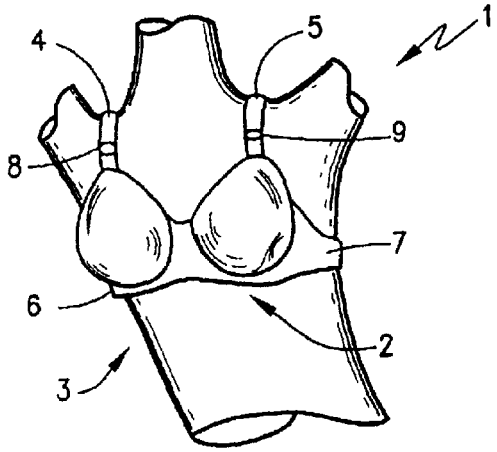
Fig.1 (PRIOR ART)
FIG. 1 is a perspective view of a woman wearing a garment in the form of a brassiere according to the prior art, which garment supports her breasts according to the prior art.

In order to understand the unique versatility provided by the garment of the present invention, reference is first made to the traditional, or basic brassiere worn by many women today. Turning then to FIG. 1, woman 3 is wearing a traditional brassiere 1 that is comprised of a breast support piece 2, shoulder straps 4 and 5, and back straps 6 (not shown) and 7. In this particular configuration of the traditional brassiere, two individual breast cups are bridged together by a piece of material to form the breast support piece 2. Shoulder straps 4 and 5 are affixed to a respective breast cup as are back straps 6 and 7. Although not shown, back straps 6 and 7 extend around the torso of woman 3 to connect around her back. Shoulder straps 4 and 5 are affixed to back straps 6 and 7 respectively so that they are comfortably positioned on the woman's back. Adjustment buckles 8 and 9 allow for adjustment to the length of shoulder straps 4 and 5 to accommodate the comfort of the wearer.

A first exemplary embodiment of a garment according to the present invention is shown in FIGS. 2–6. Garment 10, which is being worn by woman 13, may be a brassiere, bathing suit top, or a form of outer clothing such as a halter-top. Garment 10, in any if these desired forms, may be made of either natural or synthetic material such as cotton, leather, satin, silk, nylon, spandex, polyester or the like or any combination thereof.

Figure 4:
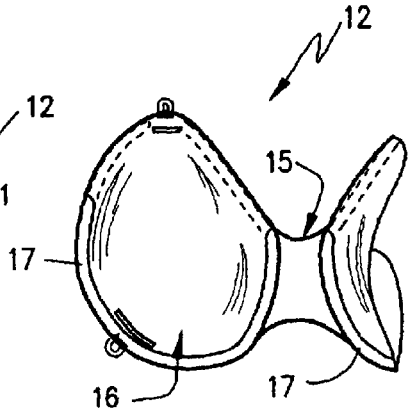
FIG. 4 is a rear view in elevation of a portion of the breast support piece shown in FIGS. 2 and 3.
Figure 5:
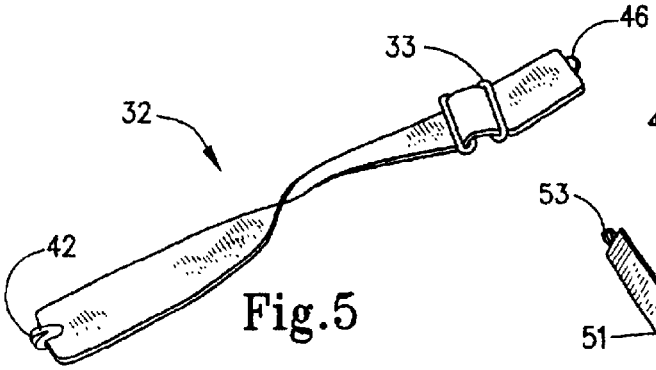
FIG. 5 is a perspective view of one of the shoulder straps used to secure the breast support piece to the woman in FIG. 2.
Figure 6:
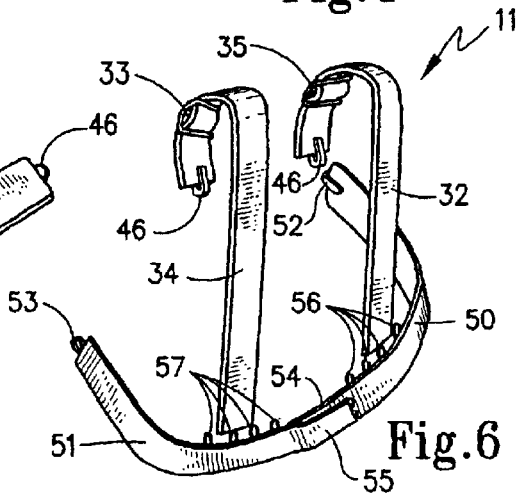
FIG. 6 is a perspective view of the strap ensemble used to secure the breast support piece to the woman in FIG. 2.

As shown in FIGS. 2–6, garment 10 generally comprises breast support piece 12, shoulder straps 32 and 34 and back straps 50 and 51, and is secured to woman 3 by strap ensemble 11, which is best shown in FIG. 6. In contrast to the traditional brassiere 1 shown in FIG. 1, shoulder straps 32 and 34, as well as back straps 50 and 51 are each releasably connected to breast support piece 12 by means of first connectors 24.

In this particular embodiment, breast support piece 12 is formed by two breast cups 14 and 16 to provide support for the breasts individually. However, breast support piece 12 may alternatively be formed as one integral piece of fabric material that is not partitioned into breast cups. Thus, if desired, breast support piece 12 could be in the form of a one-piece panel that would lack the interior concavities of the breast cups.

Figure 2:
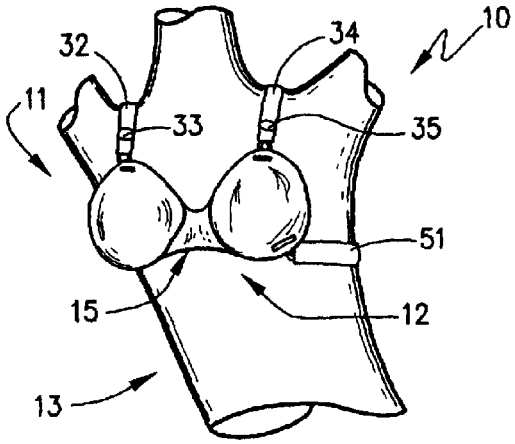
FIG. 2 is a perspective view of a woman wearing a first exemplary embodiment of the garment according to the present invention.

As shown in FIGS. 2 and 4, breast cups 14 and 16 are joined together by connection piece 15. Connection piece 15 may be formed by a piece of fabric material or may be formed of anything that could bridge the two cups. Thus, the two cups could be connected by matable fasteners such as buttons, zippers, snaps, ribbons, ties, hook and loop fasteners, and buckles. Alternatively, breast cups 14 and 16 may be disjoined and held in place by some configuration of shoulder straps 32 and 34 and back straps 50 and 51.

As shown in FIG. 4, breast cups 14 and 16 may optionally include an underwire structure 17 if desired. Underwire structure 17 is adapted to provide additional support from underneath the breasts that may provide added comfort to the wearer and retain the form of the breast cup. Underwire structure 17 may be formed of a metal such as stainless steel, or could also be formed of a hard plastic, whalebone, or even an extra piece of reinforcing fabric.

Figure 3:
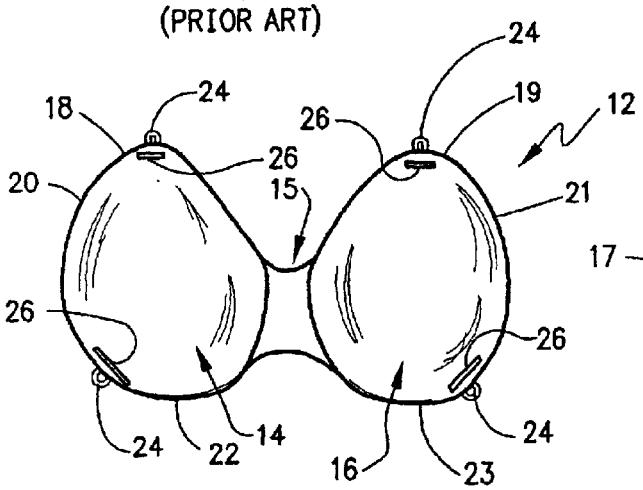
FIG. 3 is a front view in elevation of the breast support piece of the present invention that is being worn by the woman in FIG. 2.

As shown in FIG. 3, breast cups 14 and 16 have respective top edge portions 18 and 19, respective side edge portions 20 and 21, and respective bottom edge portions 22 and 23. When an appropriately sized garment 10 is worn by a woman, side edge portion 20 preferably extends laterally of the right breast and side edge portion 21 preferably extends laterally of the left breast. Also when worn, bottom edge portion 22 preferably extends underneath the right breast while bottom edge portion 23 preferably extends underneath the left breast. Together, bottom edge portions 22 and 23 may form a common bottom edge extending between side edge portions 20 and 21. Similarly, top edge portions 18 and 19 may form a common top edge that is located upwardly of the bottom edge and between side edge portions 20 and 21. As shown in FIG. 2, top edge 18 and 19 is located above the breasts such that the majority of each respective breast is covered by cups 14 and 16. It should be understood by one ordinarily skilled in the art that cups 14 and 16 could have any variety of shapes such that top edge 18, 19 could be spaced from bottom edge 22, 23 so as to partially or wholly expose the breasts.

As mentioned above, straps 32, 34, 50 and 51 are releasably connected to breast support piece 12 by means of first connectors 24. First connectors 24 are shown in the form of eyes, which are adapted to be engaged, for example, by hook 46 on the end of strap 32. The hook and eye construction can be formed of a stainless steel material or other metal, but can also be formed of fabric or plastic. Further, the eye construction may be disposed on the breast support piece by means of stitching or the like. In addition, the eye construction may also be in the form of a sleeve or loop made of fabric, plastic, or other suitable material, which protrudes from an edge of the breast support piece 12.

First connectors 24 are not limited to the form of an eye. Rather, first connectors 24 can be a variety of types of connectors that may include connectors in the form of hooks, openings, snaps, buttons, rings, or the like. With respect to connectors in the form of openings, the present invention contemplates any type of aperture capable of being engaged as a means for securing the breast support piece 12 onto the individual. Such openings include circular holes, slits, and slots. With respect to connectors in the form of rings, the present invention contemplates a closed construction that could have any shape such as a D-ring or an O-ring. Further, it should be understood that reference to "first connectors" is not intended to mean that each connector 24 must be of the same type of connector. Rather, each "first connector" 24 may be of a different type such as those various types described above. Thus, first connectors 24 could refer to any combination of possible connectors that could be used as a means to secure the breast support piece 12 to the individual's body.

First connectors 24 are spaced apart from one another and are located proximately to the edges of breast support piece 12. Specifically, with reference to FIG. 3, each breast cup 14 and 16 includes two first connectors 24. On breast cup 14, there is a first connector 24 located proximately to bottom edge portion 22 and another first connector 24 located proximately to top edge portion 18. Similarly, with respect to breast cup 16, there is a first connector 24 located proximately to bottom edge portion 23 and another first connector 24 located proximately to top edge portion 19. As used herein, "proximately to" is understood to mean either on or near the edge portion. It should be understood that first connectors 24 are not limited to these described locations. Instead, first connectors 24 can be spaced about breast cups 14 and 16 and could be located, for example, proximately to a respective side edge portion 20 or 21. Also, first connectors 24 could be located proximately to a junction of a side edge portion 20, 21 and a bottom edge portion 22, 23, or to a junction of a side edge portion 20, 21 and a top edge portion 18, 19. Such locations would be any now used or later desired location as within the ordinary skill of a clothing designer.

Optionally, breast support piece 12 may also have disposed thereon a set of second connectors 26. Second connectors 26 are shown in FIGS. 2–4 in the form of slit openings. Second connectors 26 are not limited to the form of slit openings. Rather, as described above in reference to first connectors 24, second connectors 26 may be in the form of hooks, eyes, snaps, buttons, or rings. Further, it should be understood that reference to "second connectors" is not intended to mean that each connector 26 must be of the same type of connector. Rather, each "second connector" 26 may be of a different type such as those various types described above. Thus, second connectors 24 could refer to any combination of possible connectors that could be used as a means to secure the breast support piece 12 to the individual's body. Further, first connectors 24 may be of the same or similar type of connectors as second connectors 26. Alternatively, first connectors 24 could be of a different type of connectors than second connectors 26.

Second connectors 26 are also spaced about breast support piece 12 and are disposed proximately to the edge portions of breast support piece 12 in similar fashion as that described above with respect to first connectors 24. In addition, second connectors are located proximately to first connectors 24.

As shown in FIGS. 2 and 6, breast support piece 12 is secured to woman 13 by shoulder straps 32 and 34 and back straps 50 and 51. As shown in FIG. 5, shoulder strap 32 includes hooks 42 and 46 that are located on a respective end of shoulder strap 32. Hooks 42 and 46 may be affixed to strap 32 by means of stitching or the like and may be formed of a metal, plastic, or other appropriate material. Hook 46 is adapted to engage one of the first connectors 24 of breast support piece 12, while hook 42 is adapted to engage one of back straps 50, 51 by means of back strap connectors 56 or 57. Shoulder straps 32 and 34 also have respective adjustment buckles 33 and 35 that permits its length to be varied.

Back straps 50 and 51 also have a respective hook 52 and 53 that is adapted to engage one of the first connectors 24. Back straps 50 and 51 are adapted to extend from breast support piece 12 around the woman's torso 13, to connect with one another by means of matable back strap connectors 54 and 55. These back strap connectors 54 and 55 may be any form of matable connectors such as snaps, hooks and eyes, hook and loop fasteners, buttons, ties, snaps, zippers, etc. These matable back strap connectors 54 and 55 may also be adjustable so that the length of the entire back strap 50, 51 may be varied. The ordinarily skilled artisan would understand that the back strap 50 and 51 may be constructed such that its length may be varied by means other than connectors. For example, the back strap may have a construction wherein gathers permit adjustment of the length. Alternatively, the back strap may be formed of a stretchable material such its length may be varied.

Each respective back strap 50 and 51 may also include a plurality of back strap connectors 56 and 57 disposed thereon to be engaged by hooks 42 of straps 32 and 34. As shown, back strap connectors 56 and 57 are in the form of eyes, but are not limited to this form. As described above with reference to the types of connectors that form first connectors 24 and second connectors 26, back strap connectors 56 and 57 may also be selected from the group consisting of hooks, snaps, buttons, openings, and rings.

As shown in FIG. 6, garment 10 is secured to woman 13 with strap ensemble 11, which is comprised of shoulder straps 32 and 34 and back straps 50 and 51. In this particular embodiment, strap ensemble 11 is comprised of straps. Straps, however, is to be broadly interpreted to mean any type of breast support piece fasteners that are adapted to engage at least one of the first or second connectors to secure breast support piece 12 in place. Accordingly, "strap" and "strap ensemble" collectively refers to any type of breast support piece fasteners in the form of straps, cords, strings, strands of beads, scarves, etc.

With respect to FIG. 6, if desired, shoulder straps 32 and 34 can be connected to different back strap connectors 56 and 57 so as to be closer together or farther apart to create a different look. Alternatively, if desired, shoulder straps 32 and 34 can be arranged into an X-shaped configuration. It should also be understood that multiple other strap ensembles can be created with breast support piece 12, the preferred ones of which are discussed herein.

Figure 7:
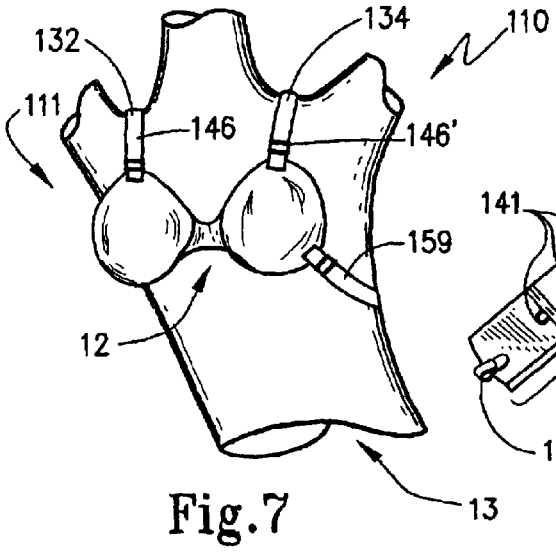
FIG. 7 is a perspective view of a woman which shows an alternative way of wearing the breast support piece shown in FIG. 3.
Figure 8:
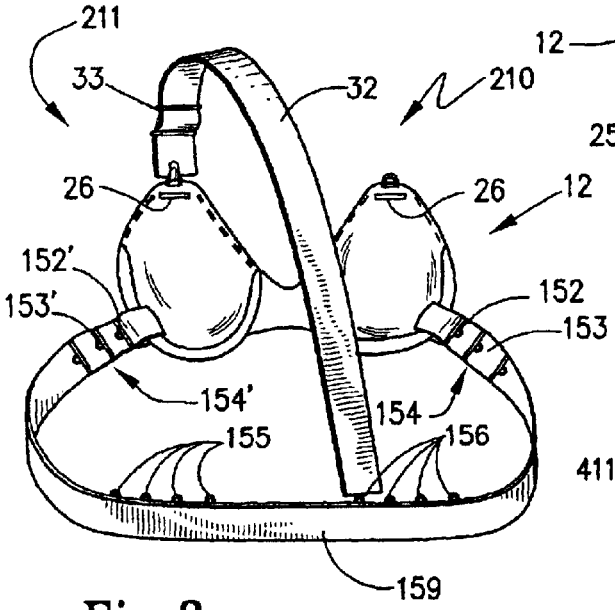
FIG. 8 is a rear view in elevation of a different strap ensemble that may be used to secure the breast support piece on to the individual.

A second exemplary embodiment of a garment according to the present invention is shown in FIG. 7. Garment 110 in FIG. 7 is again comprised of breast support piece 12. However, in this embodiment, breast support piece 12 is secured to woman 13 by strap ensemble 111 by means of second connectors 26. Strap ensemble 111 is comprised of shoulder straps 132 and 134, and a one-piece back strap 159. The way in which straps 132, 134, and 150 engage second connectors is best shown in FIG. 8 with respect to back strap 159. As shown therein, the respective ends of back strap 159 have back strap attachment mechanisms 154 and 154'. Back strap attachment mechanisms 154 and 154' are comprised of respective hooks 152 and 152', which are matable with eyes 153 and 153' respectively. With respect to attachment mechanism 154, hook 152 passes through second connector 26 and folds over on itself to mate with one of eyes 153. As shown in FIG. 8, several eyes 153 and 153' are located at the end portion of each back strap 159, which allow the length of back strap 159 to be adjusted. Similarly, shoulder straps 132 and 134 include attachment mechanisms 146 and 146', which operate to secure the respective shoulder straps 132 and 134 to breast support piece 112.

Similar to strap ensemble 11 shown in FIG. 6, shoulder straps 132 and 134 releasably connect to back strap 159 by means of hooks (not shown) that mate with eyes 155 and 156 respectively. Shoulder straps 132 and 134 can either cross over each other to form an X pattern, or remain uncrossed as described above with respect to strap ensemble 11. Alternatively, shoulder strap 32 shown with respect to garment 10 in FIGS. 2–6 described above, can be used in conjunction with back strap 159, to form strap ensemble 211 shown in FIG. 8. Further, as is shown in FIG. 8, breast support piece 12 can be secured to the individual by only one shoulder strap 32 rather than by two shoulder straps. In this configuration, shoulder strap 32 would be lengthened by means of adjustment buckle so as to create strap ensemble 211. FIG. 8 provides an example of how different straps and different strap ensembles can be used with breast support piece 12 to create the versatile garments which are the subject of the present application.

Figure 9:
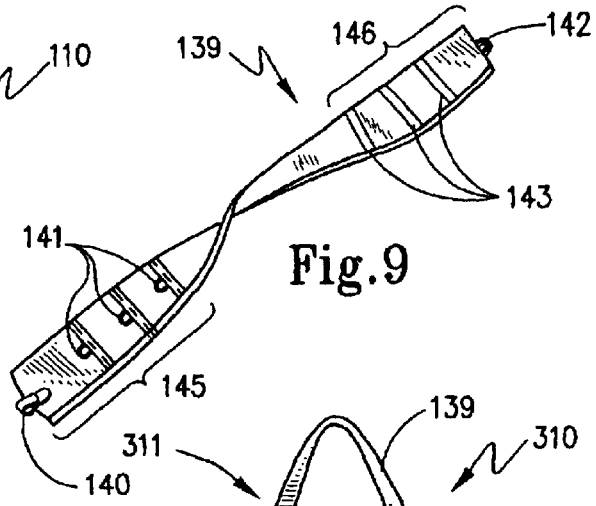
FIG. 9 is a perspective view of an alternative shoulder strap that may be used, for example, with the breast support piece of FIG. 3.
Figure 10:
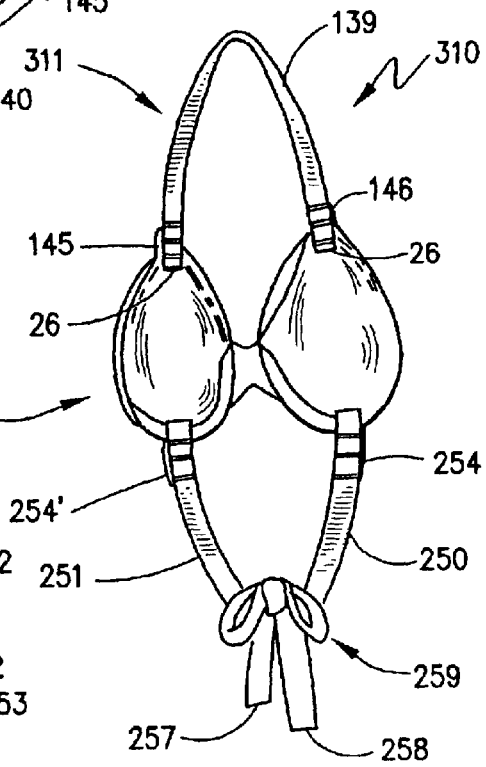
FIG. 10 is a perspective view of yet another strap ensemble that may be used, for example, with the breast support piece of FIG. 3.

FIG. 10 shows an alternative garment 310 and strap ensemble 311 according to the present invention. Strap ensemble 311 is comprised of a one-piece neck or shoulder strap 139, which is shown in FIG. 9. Shoulder strap 139 has attachment mechanisms 145 and 146 that are adapted to extend continuously around the wearer's neck. Attachment mechanisms 145 and 146 are the same as the attachment mechanisms 154 and 154' located on back strap 159 as shown in FIG. 8. As shown in FIG. 9, attachment mechanisms 145 and 146 of shoulder strap 139 include a respective hook 140 and 142, which mate with one of plurality of eyes 141 and 143. The plurality of eyes 141 and 143 enable the length of shoulder strap 139 to be adjusted. Attachment mechanisms 145 and 146 attach to respective second connectors 26 to secure breast support piece 12 to the individual.

Strap configuration 311 is further comprised of back straps 250 and 251, which are attached to second connectors 26 by means of attachment mechanisms 254 and 254' respectively. Attachment mechanisms 254 and 254' operate similarly to the attachment mechanisms 145 and 146 described above with respect to shoulder strap 139. Back straps 250 and 251 terminate in respect free ends 257 and 258, which enable back straps 250 and 251 to be tied together to form bow 259 so as to secure breast support piece 12 to the individual.

Figure 11:
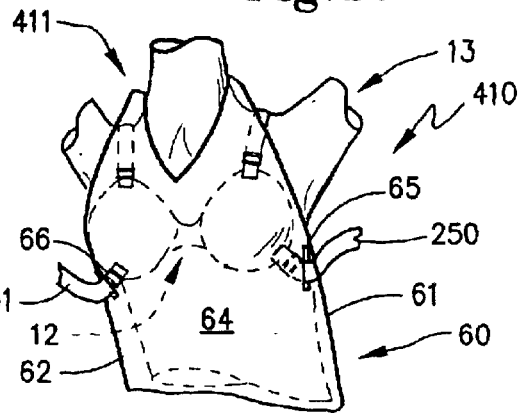
FIG. 11 is a perspective view of a woman wearing a garment system which combines the garment shown in FIG. 7 with a backless article of clothing according to the present invention.
Figure 12A:
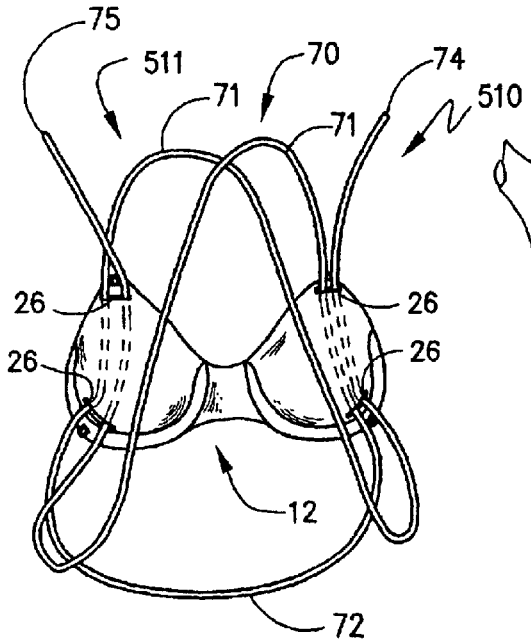
FIG. 12(*a*) is a rear view in elevation of another breast supporting garment and a single cord strap ensemble.
Figure 12B:
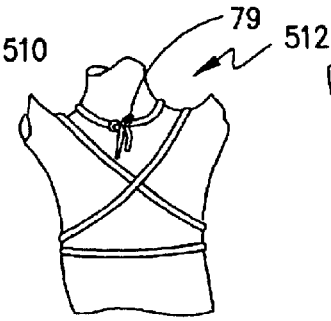
Figure 12C:
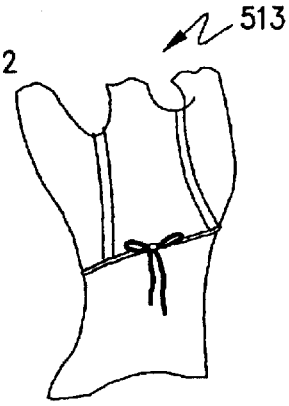
Figure 12D:
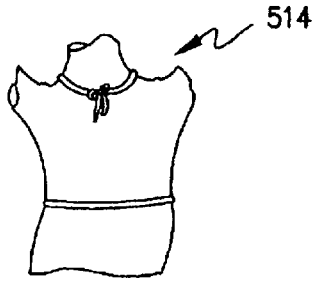
Figure 12E:
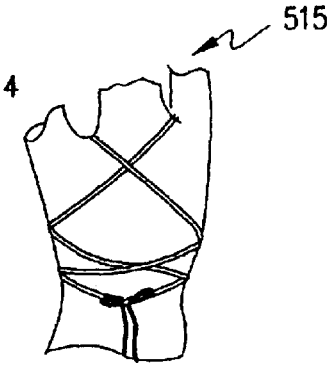

FIG. 11 shows yet another garment 410 according to the present invention. Garment 410 is a combination of garment 310 as shown in FIG. 10, and a backless article of clothing 60 that is provided by this invention to cooperate with the bra structures described herein. Backless top 60, in this embodiment, is a top worn as outer clothing, which could be a dickey, halter-top, or other form of backless top. If desired, backless top 60 could also be in the form of an undergarment. Backless top 60 has lateral side edges 61 and 62 and a front panel 64 extending therebetween. Disposed proximate to a respective side edge 61 and 62 are openings 65 and 66. As shown therein, back straps 250 and 251 extend from breast support piece 12 through a respective opening 65, 66, and are adapted to continue to extend around the woman's torso 13 to be fastened together. The free ends of back straps 250 and 251 can be fastened together by any means such as hook and eye fasteners, ties, etc. In this way, back straps 250 and 251 are securing both breast support piece 12 and backless top 60 to the woman's body 13. Further, it should be understood by a person ordinarily skilled in the art that garment 410 can include any variation of breast support piece 12 or strap ensembles previously discussed or that will be discussed herein.

FIG. 12(*a*) shows garment 510 having strap ensemble 511. In this particular embodiment, strap 70 is in the form of a cord. Cord 70 is one long continuous piece that is capable of weaving in and out of second connectors 26 of breast support piece 12 to secure it to the wearer's body. In this particular embodiment, second connectors are in the form of openings, however, it should be understood that second connectors could alternatively be openings of any of the various forms previously described. Also, if desired, a plurality of cords could also effectively secure breast support piece 12 to the wearer's body. With respect to FIG. 12(*a*), cord 70 is looped through second connectors 26 so as to form shoulder straps 71 and back strap 72 and to terminate in respective free ends 74 and 75. FIG. 12(*b*) depicts the back of a woman wearing garment 510. In FIG. 12(*b*), free ends 74 and 75 were used to create bow 79 to secure the breast support piece 12 and cord ensemble 511 in place. Cord 70 can also be used to create a variety of ensembles other than that shown in FIGS. 12(*a*) and 12(*b*), examples of which are examples 513–516 shown in FIGS. 12(*c*)–12(*f*) respectively.

Figure 13:
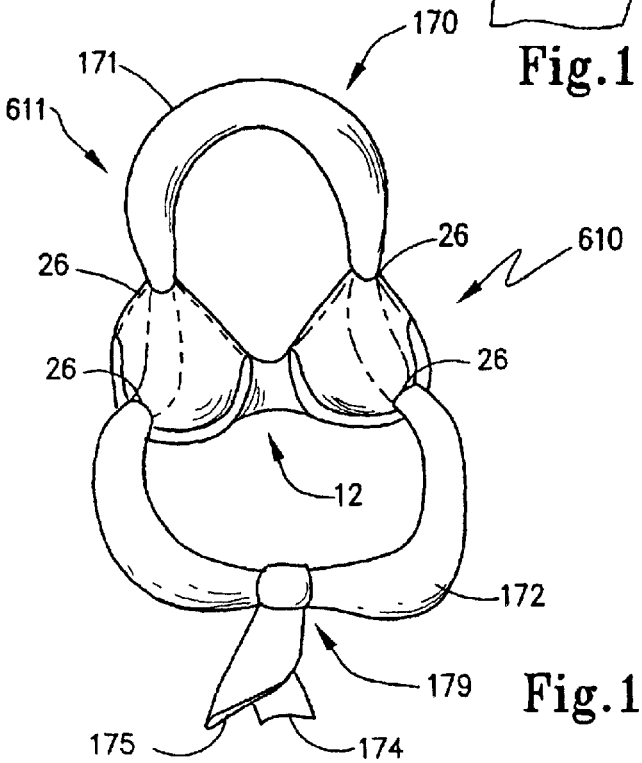
FIG. 13 is a rear view of the breast support piece of FIG. 3 showing a configuration of a scarf that may be used to secure the breast support piece.
Figure 12F:
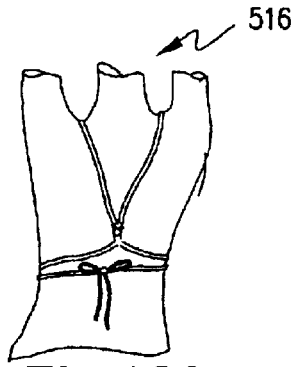

FIG. 13 shows garment 610 having strap ensemble 611. Strap ensemble 611 is in the form of a one-piece scarf 170 that is laced in and out of second connectors 26 of breast support piece 12. Strap 170 is used to create shoulder strap 171 and back strap 172, and terminates in respective free ends 174 and 175 which may be used to form bow 179. It should be understood by one ordinarily skilled in the art that one-piece scarf 170 can be used to create multiple configurations and is thus not limited to the configuration shown in FIG. 13.

As mentioned above, breast support piece 12, first connectors 24, second connectors 26, straps, and strap ensembles are not limited to the form shown in FIGS. 2–13 and previously described. Rather, these components can exist in a large variety of forms, preferred ones of which are shown and described with reference to remaining FIGS. 14–25.

Figure 14:
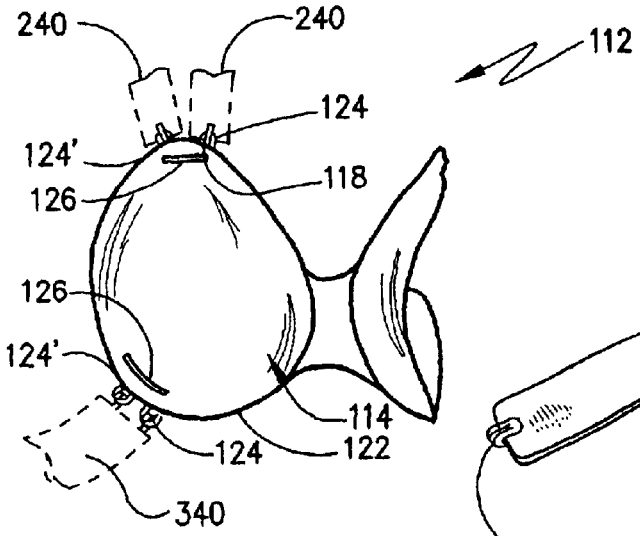
FIG. 14 is a front view in elevation of an alternative breast support piece contemplated by the present invention.

With respect to FIG. 14, an alternative breast support piece 112 is shown with possible straps attached thereto shown in phantom. FIG. 14 shows that breast cup 114 has a pair of first top connectors 124, 124' located proximately to the top edge 118 of breast cup 114. There is also a pair of first bottom connectors 124, 124' located proximately to bottom edge 122 of breast cup 114. Optionally, two second connectors 126 can be located proximately to a respective top edge 118 and bottom edge 122 of breast cup 114. First connectors 124, 124' are in the form of eyes and second connectors 126 are in the form of slit openings, but are not limited to these forms. The primary difference between breast support piece 12 of FIG. 3 and breast support piece 112 of FIG. 14 is the addition of first connectors 124' onto one breast cup 114. Of course first connectors 124' do not have to be of the same type of connector as first connector 124. Accordingly, breast cup 114 has a total of six connectors disposed thereon whereas breast cup 14, as shown in FIG. 3, for example, has a total of four connectors disposed thereon. The addition of first connectors 124' permits the ability of using different types of straps 240 and 340 which have been shown in phantom. Straps 240 and 340 are shown in FIGS. 15 and 16 respectively.

Figure 15:
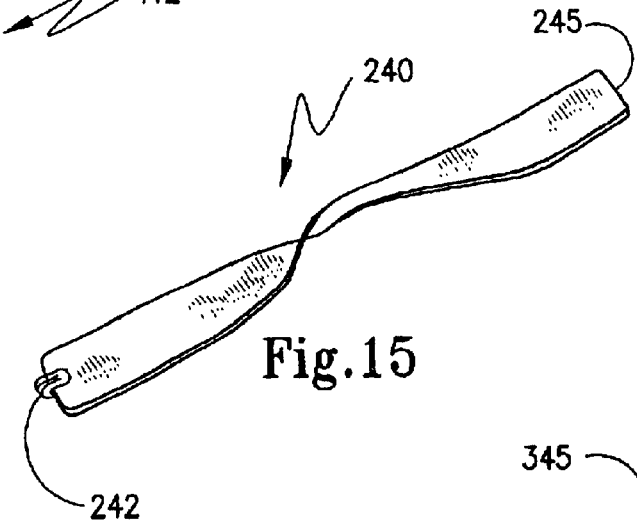
FIG. 15 is a perspective view of an alternative strap design that may be used, for example, with the breast support piece of FIG. 14.
Figure 16:
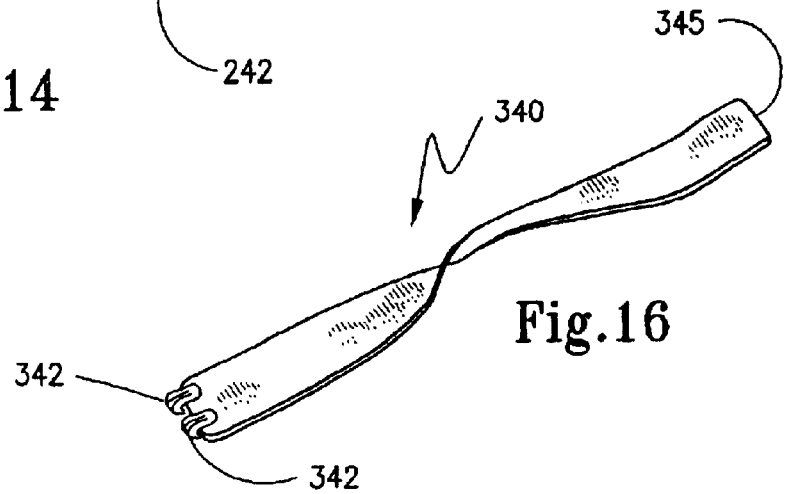
FIG. 16 is a perspective view of yet another strap design that may be used with the breast support piece shown in FIG. 14.

With respect to FIG. 15, strap 240 has one hook 242 on one end and the other end 245 is a free end. Similarly, FIG. 16 shows strap 340 with two hooks 342 on one end and the other end 345 is a free end. Both straps 240 and 340 may be used on brassiere support piece 112 to create any multiple configuration thereof.

Figure 17:
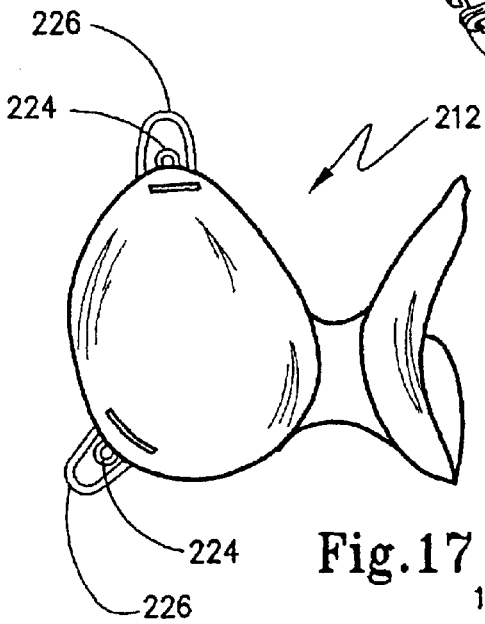
FIG. 17 is a front view in elevation showing the right portion of an alternative construction for the breast support piece and an alternative connector by which a strap member may be used to secure it to the individual.
Figure 18:
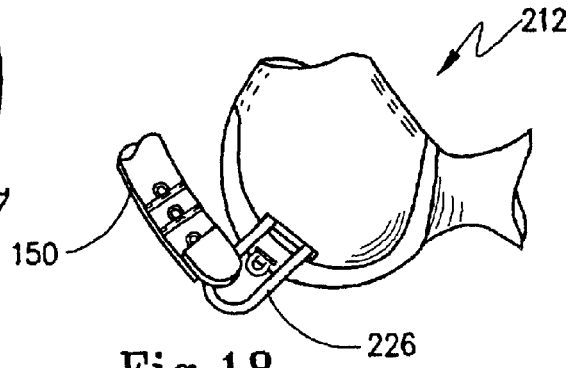
FIG. 18 is a rear view in elevation showing the left portion of the breast support piece shown in FIG. 17.

FIGS. 17 and 18 show breast support piece 212 where second connector 226 is in the form of a ring. In particular, FIGS. 17 and 18 depict a D-ring, but the form of ring 226 is not limited to a D-ring, but could be any ring of a closed construction as previously described above that permits a strap of some sort to be releasably secured thereto. FIG. 18 shows how D-ring 226 can be used in conjunction with back strap 150 described above with reference to FIG. 8.

Figure 19A:
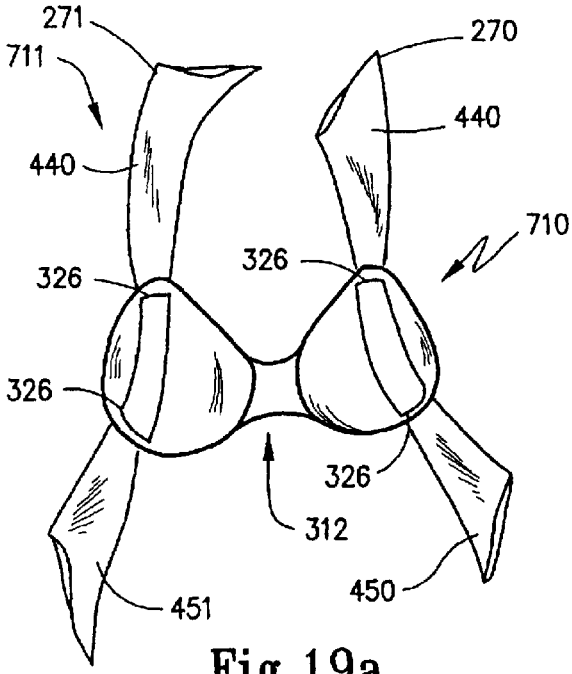
FIG. 19(*a*) is a front view of an alternative breast support piece and scarf ensemble.
Figure 19B:
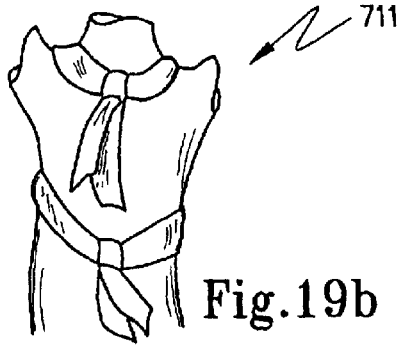

FIGS. 19(*a*) and 19(*b*) shows garment 710 having strap configuration 711 wherein breast support piece 312 includes first connectors 326 in the form of openings adapted to be engaged by a respective scarf 270 and 271. Scarves 270 and 271 form neck or shoulder straps 440 and back straps 450 and 451. It should be noted that in this embodiment, breast support piece 312 lacks second connectors. FIG. 19(*b*) depicts the back of a woman wearing garment 710 with strap configuration 711.

Figure 20:
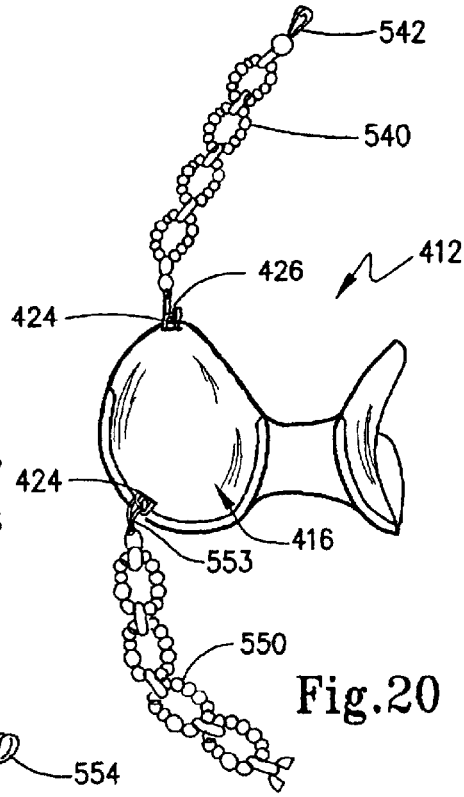
FIG. 20 is a rear view in elevation of an alternative breast support piece and strap design wherein the strap is formed by a strand of beads.
Figure 21:
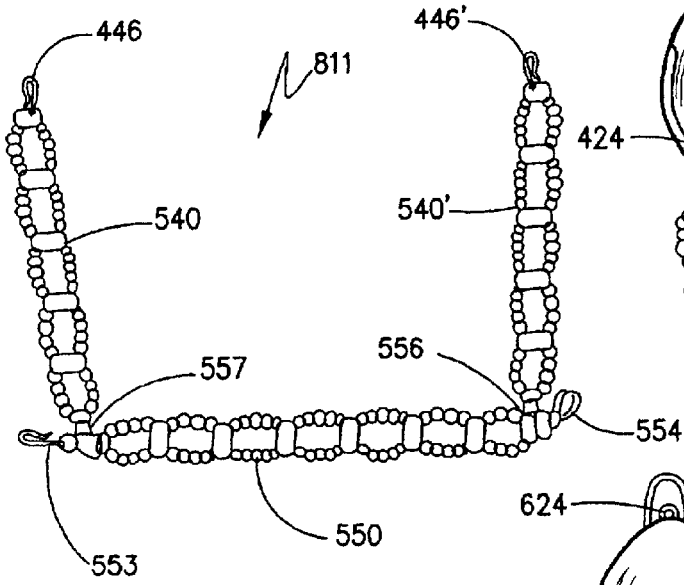
FIG. 21 is a rear view in elevation of a possible strap ensemble where the straps are formed by a strand of beads.

FIG. 20 shows an alternative breast support piece 412 where breast cup 416 only includes first connectors 424 in the form of eyes, thus lacking second connectors. Of course, first connectors 424 are not limited to the form of an eye and may include other types of connectors as previously discussed. Further, FIG. 20 shows yet another alternative shoulder strap construction 540 and back strap construction 550 in the form of a strand of beads. The strand of beads 540 and 550 releasably secure to breast support piece 412 by means of hooks 446 and 553 respectively, which are adapted to engage first connectors 424. As best shown in FIG. 21, back strap 550 is formed as an interlocking link of beads that is adapted to extend continuously around the woman's back. Back strap 550 includes shoulder strap attachments 556 and 557 that are adapted to be engaged by hook 542 located on one end of a respective shoulder strap 540 and 540'. Accordingly then, in FIG. 21 shoulders straps 540 and 540' and back strap 550 cooperatively engage each other to form the strap ensemble 811. Strap ensemble 811 is not limited to this configuration, but rather can have an X configuration, or be used in combination with other types of straps, etc. Further, straps in the form of beads can alternatively be formed of a strand of beads or even a plurality of strands of beads. Further, "beads" can be interpreted to mean a wide variety of objects including rhinestones, gems, or the like.

Figure 22:
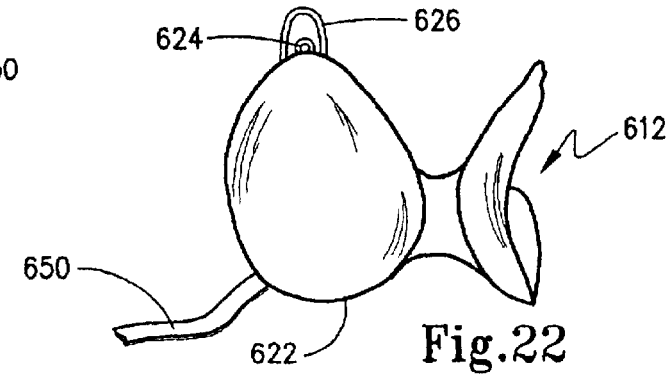
FIG. 22 is a front view in elevation of yet another garment design.

FIG. 22 shows an alternative breast support piece 612. Breast support piece 612 has a back strap 650 permanently affixed proximately to bottom edge 622 by sewing or the like. Strap 650 can engage either first or second connectors to secure the breast support piece 612 on to an individual's body.

Figure 23:
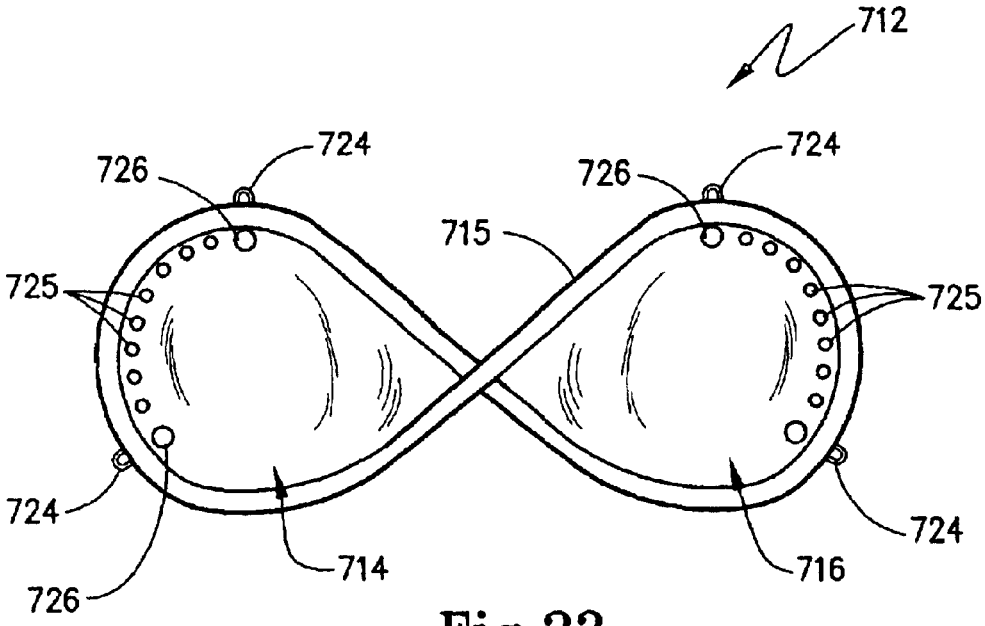
FIG. 23 is a front view in elevation of an alternative breast support piece construction.

FIG. 23 shows an alternative embodiment of the breast support, piece 712. Breast support piece 712 is comprised of breast cups 714 and 716, and an integral one piece framework 715 that either partially or wholly encircles the breasts. Breast cups 714 and 176 may be formed of a fabric material in a flat panel or cup configuration such as that described above. Alternatively, a one-piece panel may extend over the entire framework so as to either partially or wholly cover the breasts.

Breast support piece further includes first connectors 724 and second connectors 726. First connectors 724 are in the form of plastic, metal, or fabric eyes while second connectors are in the form of openings 726. However, the openings 726 formed as second connectors are a different shape from those shown in FIGS. 3–4 of breast support piece 12. In FIGS. 3–4, second connectors 26 are openings of one type. Here, in FIG. 24, the openings that form second connectors 726 are constructed as openings of a different type. In addition, an array of additional openings 725 are shown on breast support piece 725. Openings 725 may serve either as a decorative feature, or could be used to provide additional attachment points for the chosen strap configuration.

Figure 24:
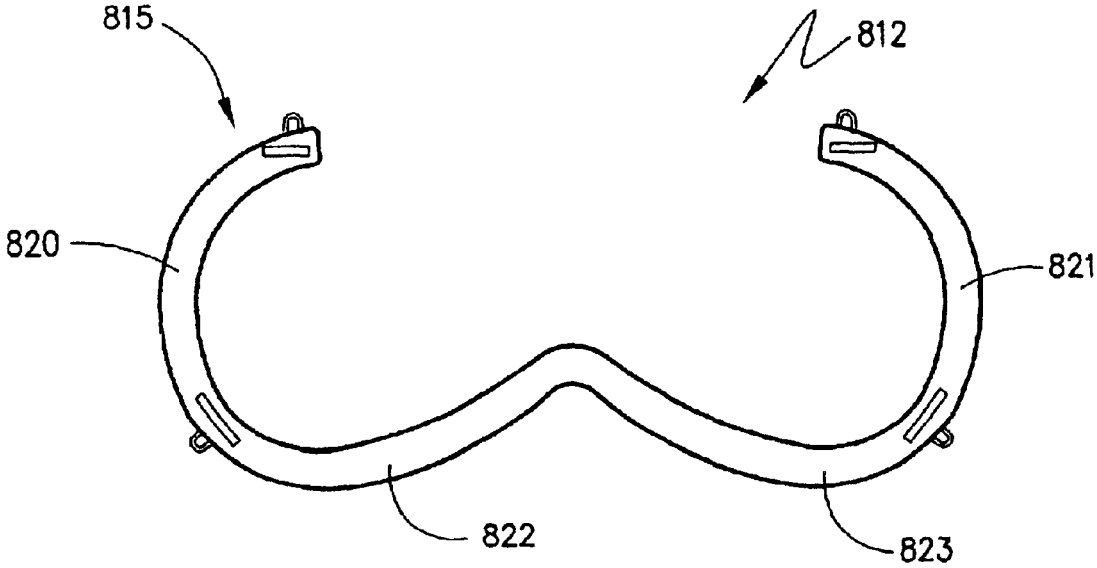
FIG. 24 is a front view in elevation of a different breast support piece construction.

Finally FIG. 24 shows a breast support piece 812 in the form of a framework 815 having side edge portions 820 and 821 and bottom edge portions 822 and 823 which partially encircle the breasts. Breast support piece 812 lacks a top edge portion and further lacks breast cups. Accordingly, breast support piece 812 is intended to individually support the breasts with framework 815 without fabric breast cups. If desired, however, a piece of fabric material could be added so as to extend between side edge portions 822 and 823. Without breast cups or a fabric material, breast support piece 812 provides the wearer the ability to obtain support for her breasts, while at the same time creating a braless look when worn in combination with an article of clothing.

Accordingly, the present invention has been described in great detail with reference to FIGS. 2–24. A person of ordinary skill in the art should understand that the breast support pieces, first connectors, second connectors, straps, and strap ensembles may be interchanged among the various figures and descriptions provided above to form a garment according to the present invention. In other words, it should be understood that a variety of strap ensembles may be used with any one of a variety of breast support pieces as shown and described above.

Further, any combination of first connectors second connectors may be used in conjunction with the breast support piece to further expand the variety of garments that are contemplated by the present invention. As discussed above, references to first connectors and second connectors collectively refers to any type of connector that may be selected from a group consisting of hooks, eyes, snaps, buttons, and openings, which have also been further explained above.

Also, as described above, "straps" collectively refers to any type of component that is able to engage the connectors disposed on the breast support piece so as to secure the breast support piece in a supporting relationship to the individual's breast. Accordingly, these straps can be of varying lengths, widths, fabric material or otherwise, colors, etc.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A garment structure adapted to support an individual's breasts when secured on the individual's body, comprising:

(A) a strapless flexible breast support piece including a left section adapted to support the left breast and a right section adapted to support the right breast and having a left side edge, a right side edge, and a bottom edge;

(B) a first left bottom connector disposed proximately to said bottom edge;

(C) a first right bottom connector disposed proximately to said bottom edge in spaced relation to said first left bottom connector;

(D) a first left side connector disposed proximately to said left side edge and located upwardly of said first left bottom connector;

(E) a first right side connector disposed proximately to said right side edge and located upwardly of said first right bottom connector;

(F) a second left bottom connector disposed proximately to said bottom edge;

(G) a second right bottom connector disposed proximately to said bottom edge in spaced relation to said second left bottom connector;

(H) a second left side connector disposed proximately to said left side edge and located upwardly of said second left bottom connector; and (I) a second right side connector disposed proximately to said right side edge and located upwardly of said second right bottom connector.

2. A garment structure according to claim 1 wherein said breast support piece is formed as an integral one-piece construction of a fabric material.

3. A garment structure according to claim 1 wherein said breast support piece is a framework including a left frame section that extends along a peripheral portion of the left breast and a right frame section that extends along a peripheral portion of the right breast.

4. A garment structure according to claim 3 wherein said framework includes a flexible cup operative to cover a major portion of the left breast and another flexible cup operative to cover a major portion of the right breast.

5. A garment structure according to claim 1 wherein said left side edge is adapted to extend laterally of the left breast, said right side edge is adapted to extend laterally of the right breast, and said bottom edge is adapted to extend below both breasts, between said left and said right side edge when worn.

6. A garment structure according to claim 1 wherein each of said first connectors is selected from a group consisting of hooks, eyes, buttons, openings, snaps, and rings.

7. A garment structure according to claim 1 wherein each of said second connectors is selected from a group consisting of hooks, eyes, buttons, openings, snaps, and rings.

8. A garment according to claim 1 wherein:

(A) said second left bottom connector is disposed proximately to said first left bottom connector;

(B) said second right bottom connector is disposed proximately to said first right bottom connector;

(C) said second left side connector is disposed proximately to said first left side connector; and (D) said second right side connector is disposed proximately to said first right side connector.

9. A garment according to claim 8 wherein each of said first connectors is of a similar first type and each of said second connectors are of a similar second type different from the first type.

10. A garment adapted to support an individual's breasts when worn, comprising:

(A) a flexible breast support piece including a left section adapted to support the left breast and a right section adapted to support the right breast such that when said breast support piece is worn by the individual, a left side edge is adapted to extend laterally of the left breast, a right side edge is adapted to extend laterally of the right breast, and a bottom edge is adapted to extend below both breasts between said left side edge and said right side edge;

(B) a set of first connectors of a first type, including 1. a first left bottom connector disposed proximately to said bottom edge;
2. a first right bottom connector disposed proximately to said bottom edge in spaced relation to said first left bottom connector;
3. a first left side connector disposed proximately to said left side edge and located upwardly of said first left bottom connector; and
4. a first right side connector disposed proximately to said right side edge and located upwardly of said first right bottom connector; and (C) a set of second connectors of a second type different from the first type, including 1. a second left bottom connector disposed proximately to said first left bottom connector;
2. a second right bottom connector disposed proximately to said first right bottom connectors;
3. a second left side connector disposed proximately to said first left side connector; and
4. a second right side connector disposed proximately to said first right side connector; and (D) a plurality of garment support components each adapted to engage at least one member of said set of first or said second connectors and retain said breast support piece on the individual's body when worn, wherein one of said garment support components includes a fastening element adapted to allow for positive engagement with another one of said garment support components.

11. A garment according to claim 10 wherein said garment is selected from a group consisting of brassieres, halter-tops, and bathing suits.

12. A garment according to claim 10 wherein each of said first and second connectors is selected from a group consisting of hooks, eyes, buttons, openings, snaps, and rings.

13. A garment according to claim 10 wherein said garment support component is selected from a group consisting of a strap, a strand of beads, and a scarf.

14. A garment according to claim 10 wherein said garment support component has an adjustable length.

15. A garment adapted to support an individual's breasts when worn, comprising:

(A) a flexible breast support piece including a left section adapted to support the left breast and a right section adapted to support the right breast such that when said breast support piece is worn by the individual, a free left side edge extends laterally of the left breast, a free right side edge extends laterally of the right breast, a bottom edge extends below both breasts between said free left side edge and said free right side edge, and a top edge spaced upwardly of said bottom edge extends between said free left side edge and said free right side edge;

(B) a pair of first connectors, including:

(1) a first left top connector disposed proximately to said top edge; and (2) a first right top connector disposed proximately to said top edge in spaced relation to said first left top connector;

(C) a left garment strap affixed to said breast support piece at a location spaced apart to and downward from said first left top connector and including a left strap free end capable of engaging one of said first left and said first right top connectors;

(D) a right garment strap affixed to said breast support piece at a location spaced apart to and downward from said first right top connector and including a right strap free end capable of engaging one of said first left and said first right top connectors.

16. A garment according to claim 15 wherein said garment is selected from a group consisting of brassieres, halter-tops, and bathing suits.

17. A garment according to claim 15 wherein said left section is configured as a left breast cup and said right section is configured as a right breast cup.

18. A garment according to claim 17 wherein said wherein each of said left and right breast cups includes an underwire structure.

19. A garment according to claim 15 wherein said pair of first connectors are selected from a group consisting of hooks, eyes, buttons, openings, snaps, and rings.

20. A garment according to claim 15 wherein said breast support piece includes a pair of second connectors wherein:

(A) a second left top connector is disposed proximately to said first left top connector; and (B) a second right top connector is disposed proximately to said first right top connector.

21. A garment according to claim 20 wherein said pair of second connectors are selected from a group consisting of hooks, eyes, buttons, openings, snaps, and rings.

22. A garment according to claim 20 wherein each one of said pair of second connectors is of the same type as each one of said first pair of connectors.

23. A brassiere adapted to support an individual's breasts when worn, comprising:

(A) a breast support piece including (1) a left breast cup having an interior concavity for receiving the left breast;

(2) a right breast cup, securable to said left breast cup, having an interior concavity for receiving the right breast;

(B) a pair of first lower connectors, there being one first lower connector disposed along a bottom portion of said left cup and another first lower connector disposed along a lower portion of said right cup;

(C) a pair of first upper connectors, of a first type, there being one first upper connector disposed along an upper portion of said left cup and another first upper connector disposed along an upper portion of said right cup;

(D) a pair of second lower connectors, there being one second lower connector disposed along a bottom portion of said left cup and another second lower connector disposed along a lower portion of said right cup;

(E) a pair of second upper connectors, of a second type different from the first type, there being one second upper connector disposed along an upper portion of said left cup and another second upper connector disposed along an upper portion of said right cup;

(F) means for engaging at least one member of said first pair or second pair of connectors and for retaining said breast support piece on the individual's body.

24. A brassiere according to claim 23 wherein said first connectors and said second connectors are each selected from a group consisting of hooks, eyes, buttons, openings, snaps, and rings.

25. A brassiere according to claim 23 wherein said means for engaging said first pair or said second pair of connectors thereby to retain said breast support piece on the individual's body includes a plurality of brassiere support components wherein at least one of said brassiere support components includes at least one fastening element adapted to allow another one of said brassiere support components to positively engage the first.

26. A brassiere according to claim 23 wherein said means for engaging said first pair or said second pair of connectors thereby to retain said brassiere support piece on the individual's body is selected from a group consisting of a strap, a strand of beads, and a scarf.

27. A garment system adapted to support an individual's breasts when worn, comprising:

(A) a backless article of clothing including two lateral side edges and a front panel extending therebetween, said lateral side edges having an opening disposed in a margin proximate to each respective said lateral side edge;

(B) a breast support piece adapted to be worn underneath said backless article of clothing and including (1) a left section adapted to support the left breast and a right section adapted to support the right breast such that when said breast support piece is worn by the individual, a left side edge extends laterally of the left breast, a right side edge extends laterally of the right breast, and a bottom edge extends below both breasts between said left side edge and said right side edge;

(2) a first left bottom connector disposed proximately to said bottom edge;

(3) a first right bottom connector disposed proximately to said bottom edge in spaced relation to said first left bottom connector;

(4) a first left side connector disposed proximately to said left side edge and located upwardly of said first left bottom connector; and (5) a first right side connector disposed proximately to said right side edge and located upwardly of said first right bottom connector;

(C) at least one garment support component operative to extend through said openings and to engage at least one of said first connectors so as to secure said backless article of clothing and said breast support piece to the individual.

28. A garment system according to claim 27 wherein said backless article of clothing is a dickey.

29. A garment system according to claim 27 wherein said breast support piece includes:

(A) a second left bottom connector disposed proximately to said bottom edge;

(B) a second right bottom connector disposed proximately to said bottom edge in spaced relation to said second left bottom connector;

(C) a second left side connector disposed proximately to said left side edge and located upwardly of said second left bottom connector; and (D) a second right side connector disposed proximately to said right side edge and located upwardly of said second right bottom connector.

30. A garment system according to claim 27 wherein said garment support component is selected from a group consisting of a strap, a strand of beads, and a scarf.

31. A method of securing a garment to an individual's body that is adapted to support the breasts of the individual when worn, comprising:

(A) placing an integral breast support piece over the breasts wherein said breast support piece includes:

(1) a pair of first lower connectors of a first type disposed along a bottom portion of said breast support piece in spaced relation to one another;

(2) a pair of second lower connectors of a second type different from the first type, disposed along a bottom portion of said breast support piece in spaced relation to one another;

(3) a pair of first upper connectors disposed along an upper portion of said breast support piece in spaced relation to one another; and (4) a pair of second upper connectors disposed along an upper portion of said breast support piece in spaced relation to one another;

(B) releasably engaging a plurality of garment support components to selected members of said pair of first upper and lower connectors or selected members of said pair of second upper and lower connectors so as to create variable configurations for retaining said breast support piece in a supporting relationship with respect to the individual's breasts.

32. A brassiere adapted to support an individual's breasts when worn, comprising:

(A) a left breast cup affixed to a right breast cup;

(B) a pair of first lower connectors of a first type, there being one first lower connector disposed along a bottom portion of said left cup and another first lower connector disposed along a lower portion of said right cup;

(C) a pair of first upper connectors there being one first upper connector disposed along an upper portion of said left cup and another first upper connector disposed along an upper portion of said right cup;

(D) a pair of second lower connectors of a second type different from the first type, there being one second lower connector disposed along a bottom portion of said left cup and another second lower connector disposed along a lower portion of said right cup;

(E) a pair of second upper connectors there being one second upper connector disposed along an upper portion of said left cup and another second upper connector disposed along an upper portion of said right cup;

(F) means for engaging at least one member of said first pair or second pair of connectors for retaining said breast support piece on the individual's body whereby each member of said first pair and said second pair of connectors exists in an unconnected state when not engaged and is adapted to switch into a connected state when engaged.

33. A method of securing a garment to an individual's body that is adapted to support the breasts of the individual when worn, comprising:

(A) placing an integral breast support piece over the breasts wherein said breast support piece includes:

(1) a pair of first lower connectors disposed along a bottom portion of said breast support piece in spaced relation to one another;

(2) a pair of second lower connectors disposed along a bottom portion of said breast support piece in spaced relation to one another;

(3) a pair of first upper connectors of a first type disposed along an upper portion of said breast support piece in spaced relation to one another; and (4) a pair of second upper connectors of a second type different from the first type, disposed along an upper portion of said breast support piece in spaced relation to one another;

(B) releasably engaging a plurality of garment support components with selected members of said first or said second pair of connectors; and (C) positively engaging at least one garment support component to another one of said garment support components to secure said breast support piece in a supporting relationship with respect to the individual's breasts.

34. A garment structure adapted to support an individual's breasts when secured on the individual's body, comprising:

(A) a flexible breast support piece including a left section adapted to support the left breast and a right section adapted to support the right breast and having a left side edge, a right side edge, and a bottom edge;

(B) a removably attachable first lower left connector disposed proximately to said bottom edge;

(C) a removably attachable first lower right connector disposed proximately to said bottom edge in spaced relation to said first left bottom connector;

(D) a removably attachable first upper left connector disposed proximately to said left side edge and located upwardly of said first left bottom connector;

(E) a removably attachable first upper right connector disposed proximately to said right side edge and located upwardly of said first lower right connector;

(F) a removably attachable second lower left connector disposed proximately to said bottom edge;

(G) a removably attachable second lower right connector disposed proximately to said bottom edge in spaced relation to said second lower left connector;

(H) a removably attachable second upper left connector disposed proximately to said left side edge and located upwardly of said second lower left connector; and (I) a removably attachable second upper right connector disposed proximately to said right side edge and located upwardly of said second lower right connector.

35. A garment structure adapted to support an individual's breasts when secured on the individual's body, comprising:

(A) a flexible breast support piece including a left section adapted to support the left breast and a right section adapted to support the right breast such that when said breast support piece is worn by the individual, a free left side edge extends laterally of the left breast, a free right side edge extends laterally of the right breast, a bottom edge extends below both breasts between said free left side edge and said tree right side edge, and a top edge spaced upwardly of said bottom edge extends between said free left side edge and said free right side edge;

(B) a first left bottom connector disposed proximately to said bottom edge;

(C) a first right bottom connector disposed proximately to said bottom edge in spaced relation to said first left bottom connector;

(D) a first left side connector disposed proximately to said left side edge and located upwardly of said first left bottom connector;

(E) a first right side connector disposed proximately to said right side edge and located upwardly of said first right bottom connector;

(F) a second left bottom connector disposed proximately to said bottom edge;

(G) a second right bottom connector disposed proximately to said bottom edge in spaced relation to said second left bottom connector;

(H) a second left side connector disposed proximately to said left side edge and located upwardly of said second left bottom connector; and (I) a second right side connector disposed proximately to said right side edge and located upwardly of said second right bottom connector.

* * * * *